US011433668B2

(12) United States Patent
Kato

(10) Patent No.: US 11,433,668 B2
(45) **Date of Patent: *Sep. 6, 2022**

(54) LIQUID DISCHARGE HEAD

(71) Applicant: Brother Kogyo Kabushiki Kaisha, Aichi-Ken (JP)

(72) Inventor: Yasuo Kato, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/184,705

(22) Filed: Feb. 25, 2021

(65) Prior Publication Data

US 2021/0178762 A1 Jun. 17, 2021

Related U.S. Application Data

(63) Continuation of application No. 16/910,943, filed on Jun. 24, 2020, now Pat. No. 10,960,669, which is a (Continued)

(30) Foreign Application Priority Data

Mar. 22, 2018 (JP) ..... JP2018-054557

(51) Int. Cl.
*B41J 2/14* (2006.01)
*B41J 2/18* (2006.01)

(52) U.S. Cl.
CPC ..... *B41J 2/14233* (2013.01); *B41J 2/18* (2013.01); *B41J 2002/14241* (2013.01); (Continued)

(58) Field of Classification Search
CPC ..... B41J 2/14233; B41J 2/18; B41J 2202/18; B41J 2202/12; B41J 2202/11; B41J 2002/14241; B41J 2002/14491
See application file for complete search history.

(56) References Cited

U.S. PATENT DOCUMENTS 8,632,165 B2 1/2014 Akahane et al.
8,919,929 B2 12/2014 Akahane et al.
(Continued)

FOREIGN PATENT DOCUMENTS

EP 3246163 A1 11/2017
JP 2012-143980 A 8/2012
(Continued)

OTHER PUBLICATIONS

Dec. 14, 2021—(JP) Notice of Reasons for Refusal—App 2018-054557, Machine English Translation.

*Primary Examiner* — Geoffrey S Mruk
(74) *Attorney, Agent, or Firm* — Banner & Witcoff, Ltd.

(57) ABSTRACT

There is provided a liquid discharge head including: a communication plate having a plurality of descenders in respective communication with a plurality of nozzles, a pressure chamber plate being stacked on the communication plate and having a plurality of pressure chambers, a piezoelectric element arranged in a position overlapping with the pressure chambers in a stacking direction, and a discharge common channel extending in an array direction and being in communication with the plurality of pressure chambers. The discharge common channel includes: a first discharge portion formed in the communication plate; and a second discharge portion formed in the pressure chamber plate and in communication with the first discharge portion, the second discharge portion reaching as high as to a surface of the pressure chambers at the side of the piezoelectric element along the stacking direction.

13 Claims, 13 Drawing Sheets

Related U.S. Application Data continuation of application No. 16/217,479, filed on Dec. 12, 2018, now Pat. No. 10,717,276.

(52) U.S. Cl.
CPC .. *B41J 2002/14491* (2013.01); *B41J 2202/11* (2013.01); *B41J 2202/12* (2013.01); *B41J 2202/18* (2013.01)

(56) References Cited

U.S. PATENT DOCUMENTS

| | | | | |
|---|---|---|---|---|
| 10,717,276 | B2 * | 7/2020 | Kato | B41J 2/155 |
| 10,960,669 | B2 * | 3/2021 | Kato | B41J 2/155 |
| 2012/0182354 | A1 | 7/2012 | Akahane et al. | |
| 2013/0233939 | A1 | 9/2013 | Uezawa | |
| 2014/0118443 | A1 | 5/2014 | Akahane et al. | |
| 2016/0221338 | A1 | 8/2016 | Tomimatsu et al. | |
| 2017/0096015 | A1 | 4/2017 | Odaka et al. | |
| 2017/0151784 | A1 * | 6/2017 | Giusti | B41J 2/14233 |
| 2017/0297333 | A1 | 10/2017 | Kohda et al. | |
| 2019/0210369 | A1 | 7/2019 | Hamano | |

FOREIGN PATENT DOCUMENTS

| | | | |
|---|---|---|---|
| JP | 2013-184372 | A | 9/2013 |
| JP | 2016-10862 | A | 1/2016 |
| JP | 2016-137677 | A | 8/2016 |
| JP | 2016-168804 | A | 9/2016 |
| JP | 2017-065249 | A | 4/2017 |
| JP | 2017-159482 | A | 9/2017 |
| JP | 2018-153968 | A | 10/2018 |
| JP | 2019-14066 | A | 1/2019 |
| KR | 10-2011-0047129 | A | 5/2011 |
| WO | 2016/111147 | A1 | 7/2016 |
| WO | 2018/008397 | A1 | 1/2018 |

* cited by examiner

LIQUID DISCHARGE HEAD

CROSS REFERENCE TO RELATED APPLICATION

This Application is a Continuation of application Ser. No. 16/910,943 filed on Jun. 24, 2020 (now U.S. Pat. No. 10,960,669), which is a Continuation of application Ser. No. 16/217,479 filed on Dec. 12, 2018 (now U.S. Pat. No. 10,717,276), which claims priority from Japanese Patent Application No. 2018-054557 filed on Mar. 22, 2018, the disclosures of which are incorporated herein by reference in their entirety.

BACKGROUND

Field of the Invention

The present disclosure relates to liquid discharge heads such as, for example, the liquid discharge heads of liquid discharge apparatuses.

Description of the Related Art

As an apparatus having a conventional liquid discharge head, there is known, for example, liquid discharge apparatuses. Such a liquid discharge apparatus has stacked communication plate provided with communication channels in communication with nozzles, and a channel forming substrate provided with pressure generation chambers in communication with the communication channels. A circulation channel is provided in the communication plate and the channel forming substrate and the circulation channel is in communication with the pressure generation chambers and the communication channels via a circulation communication channel. Further, with the channel forming plate, a vibration plate is provided on the surface at the far side from the communication plate and, on the vibration plate, a pressure generating means is arranged to cause a pressure change in a liquid inside the pressure generation chambers, so as to discharge the liquid from the nozzles.

SUMMARY

However, because the liquid is in contact with the external air via the nozzles even during the time of not being discharged, there is an increase in viscosity of the liquid in the vicinity of the nozzles. In order to suppress such increase in viscosity, publicly known liquid discharge apparatuses are configured to circulate the liquid as described above such that the liquid in the vicinity of the nozzles may not have an excessively high viscosity.

However, if there is a large resistance (against the flow from the liquid) in the circulation channel, then the liquid flow speed in the downstream differs from the liquid flow speed in the upstream through the circulation channel Hence, the liquid flow speed in the vicinity of the nozzles on the connected communication channels on the downstream side also differs from the liquid flow speed in the vicinity of the nozzles on the connected communication channels on the upstream side, with respect to the circulation channel. As a result, there is such an unpreferable consequence that the discharge feature of the liquid of the nozzles positioned on the downstream side differs from the discharge feature of the liquid of the nozzles positioned on the upstream side, through the circulation channel.

The present disclosure is made to solve such problems, and an object thereof is to provide a liquid discharge head capable of facilitating improvement of the discharge feature for the liquid.

According to an aspect of the present disclosure, there is provided a liquid discharge head including: a communication plate including a plurality of descenders in respective communication with a plurality of nozzles; a pressure chamber plate being stacked on the communication plate and including a plurality of pressure chambers in respective communication with the plurality of descenders; a piezoelectric element arranged at a position overlapping with the pressure chambers in a stacking direction in which the communication plate and the pressure chamber plate are stacked; and a discharge common channel extending in an array direction in which the plurality of pressure chambers are aligned and being in communication with the plurality of pressure chambers. The discharge common channel includes: a first discharge portion formed in the communication plate; and a second discharge portion formed in the pressure chamber plate and in communication with the first discharge portion, the second discharge portion reaching as high as to a surface of the pressure chambers at the side of the piezoelectric element in the stacking direction.

According to the above configuration, in the discharge common channel, the second discharge portion reaches as high as to the surface of the pressure chambers at the side of the piezoelectric element. By virtue of this, because the discharge common channel is expanded, it is possible to lessen the resistance against the liquid flow through the discharge common channel and, furthermore, to reduce the difference in resistance between the respective pressure chambers. By virtue of this, it is possible to lessen the differences in discharge speed and discharge quantity between the droplets from the nozzles due to the difference in resistance between the pressure chambers, thereby lowering discharge variation in the plurality of pressure chambers. Further, it is possible to lower the difference in liquid viscosity in the plurality of nozzles aligning in the flow direction due to the difference in resistance between the pressure chambers, thereby reducing variation in liquid discharge.

DESCRIPTION OF THE EMBODIMENT

First Embodiment

<Liquid Discharge Apparatus>

Figure 1:
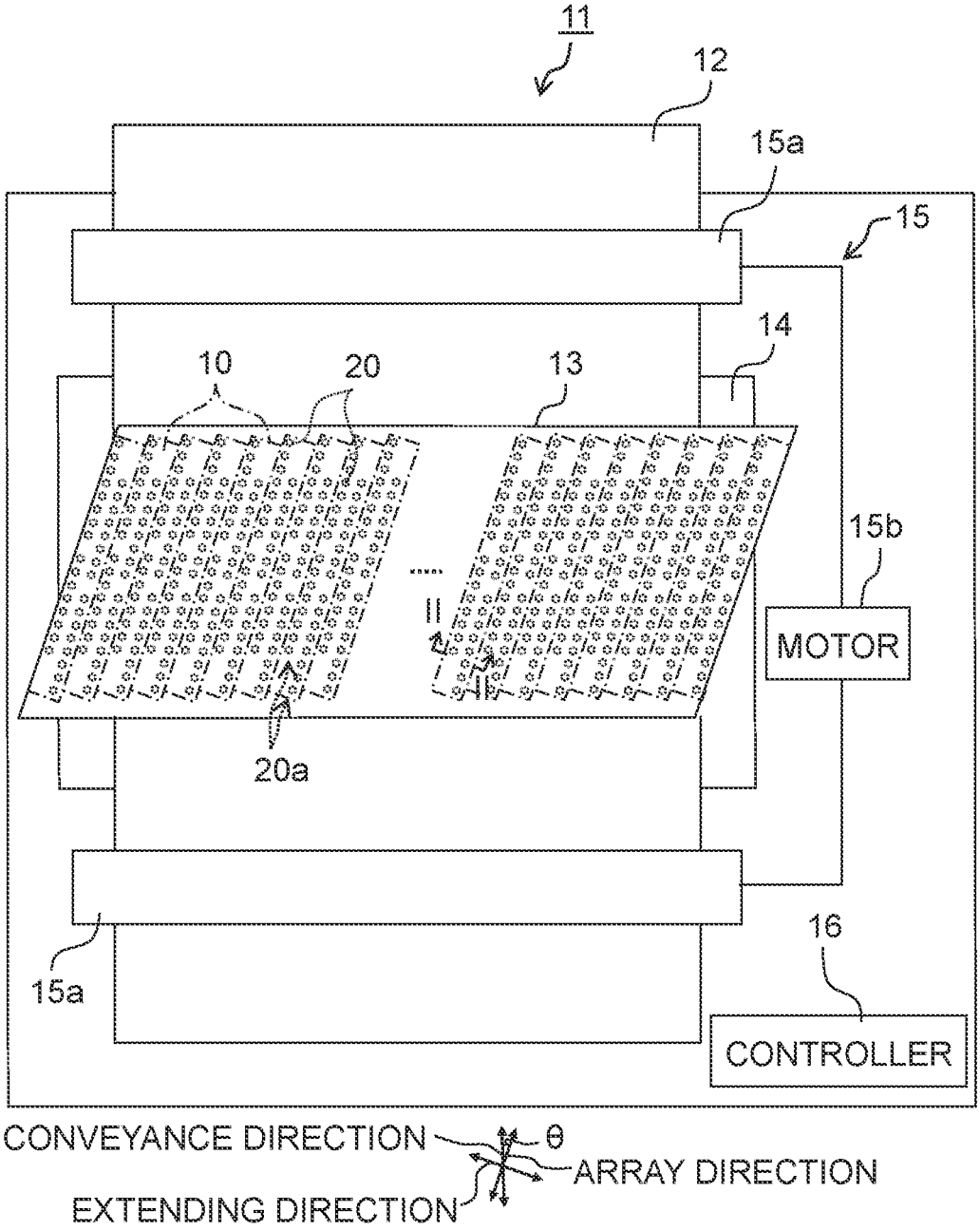
FIG. 1 is a schematic view of a head according to a first embodiment of the present disclosure.

A liquid discharge apparatus 11 using liquid discharge heads 10 (to be referred to below as "head 10") according to a first embodiment of the present disclosure is, as depicted in FIG. 1 for example, a printer configured to carry out printing on recording medium 12 with a liquid by way of discharging the liquid such as ink or the like while conveying the recording medium 12 such as printing paper or the like. Note that although the liquid discharge apparatus 11 will be explained below as an apparatus using the heads 10, apparatuses using the heads 10 are not limited thereto. Further, as the liquid discharge apparatus 11, a printer will be explained below, but the liquid discharge apparatus 11 is not limited to a printer as far as it discharges a liquid.

The liquid discharge apparatus 11 includes a head unit 13, a platen 14, a conveyance mechanism 15, and a controller 16. The head unit 13 has the plurality of heads 10, and the plurality of heads 10 are arranged to align in a direction orthogonal to a conveyance direction. Each head 10 has a plurality of nozzles 20 discharging a liquid. Details of the heads 10 will be explained later on.

The platen 14 is a flatbed to place the recording medium 12 and arranged to face the nozzle surfaces of the heads 10 where the nozzles 20 open. The conveyance mechanism 15 is to convey the recording medium 12. The conveyance mechanism 15 has four rollers 15*a* and a conveyance motor 15*b* to drive the rollers 15*a*. The four rollers 15*a* constitute two pairs of rollers which are arranged to interpose the platen 14 therebetween in the conveyance direction. The two rollers 15*a* in each pair of the rollers are arranged to interpose the recording medium 12 therebetween and caused to rotate reversely against each other by the conveyance motor 15*b*. By virtue of this, the recording medium 12 is conveyed along the conveyance direction. Note that such a configuration may be applied that between the two rollers 15*a* constituting each pair of the rollers, the drive force from the conveyance motor 15*b* is transmitted to one roller 15*a* but not transmitted to the other roller 15*b*. That is, the other roller 15*a* may be a driven roller.

The controller 16 has a computation unit (not depicted) and a storage unit (not depicted). The computation unit includes a processor such as a CPU or the like while the storage unit includes a memory which can be accessed by the computation unit. The computation unit executes programs stored in the storage unit to control the head unit 13 and the conveyance mechanism 15 of the liquid discharge apparatus 11.

<Head>

As depicted in FIG. 1, in each head 10, the plurality of nozzles 20 form two nozzle arrays 20*a* arrayed linearly in an array direction forming a predetermined angle θ to the conveyance direction. The two nozzle arrays 20*a* are provided to align parallel to each other at an interval along a width direction orthogonal to the array direction. The two nozzle arrays 20*a* include the same number of nozzles 20. Further, the angle θ between the array direction and the conveyance direction is set, for example, from 30 degrees to 60 degrees.

Figure 2:
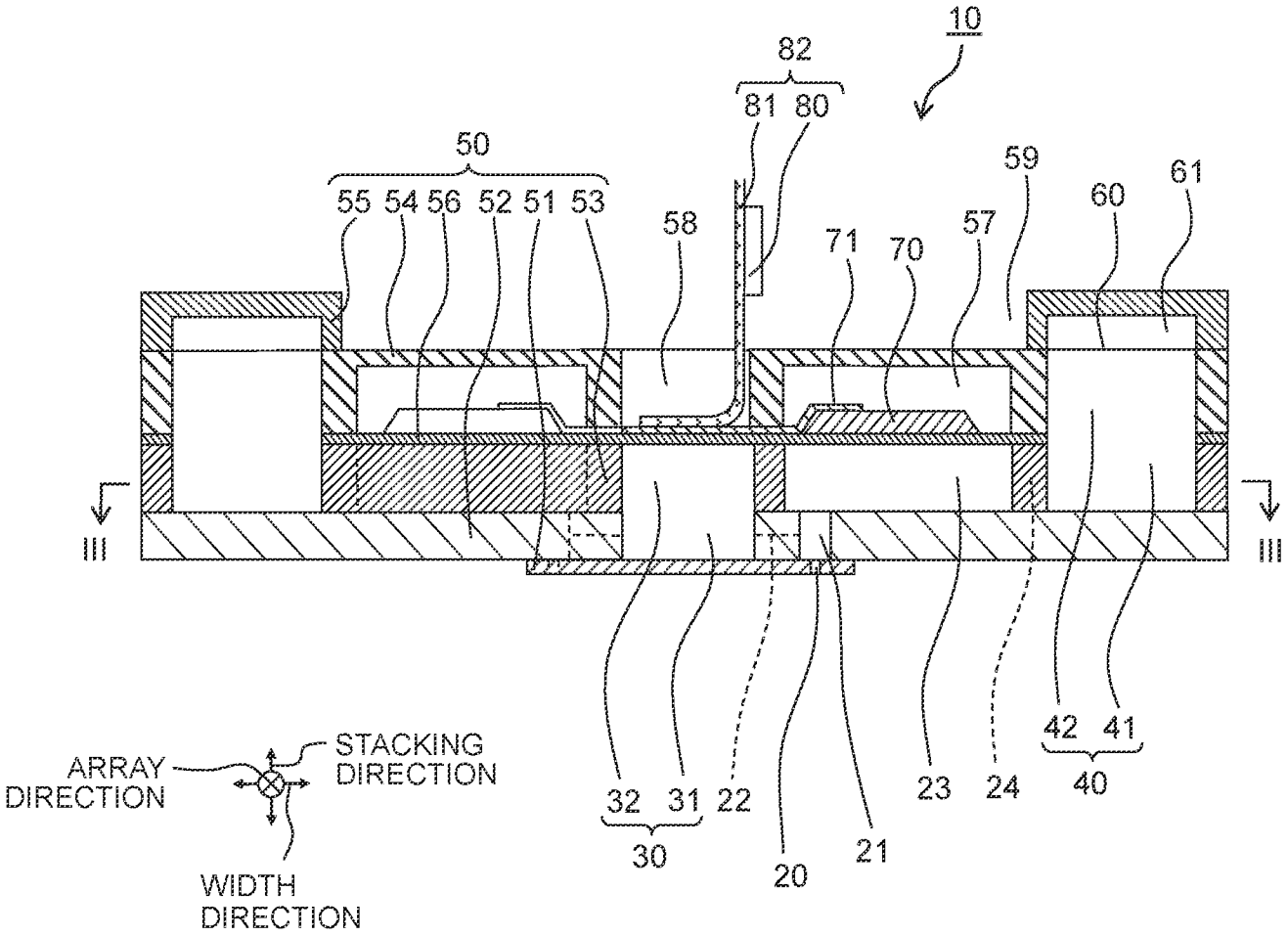
FIG. 2 is a cross-sectional view of the head cut along the line II-II of FIG. 1.
Figure 3:
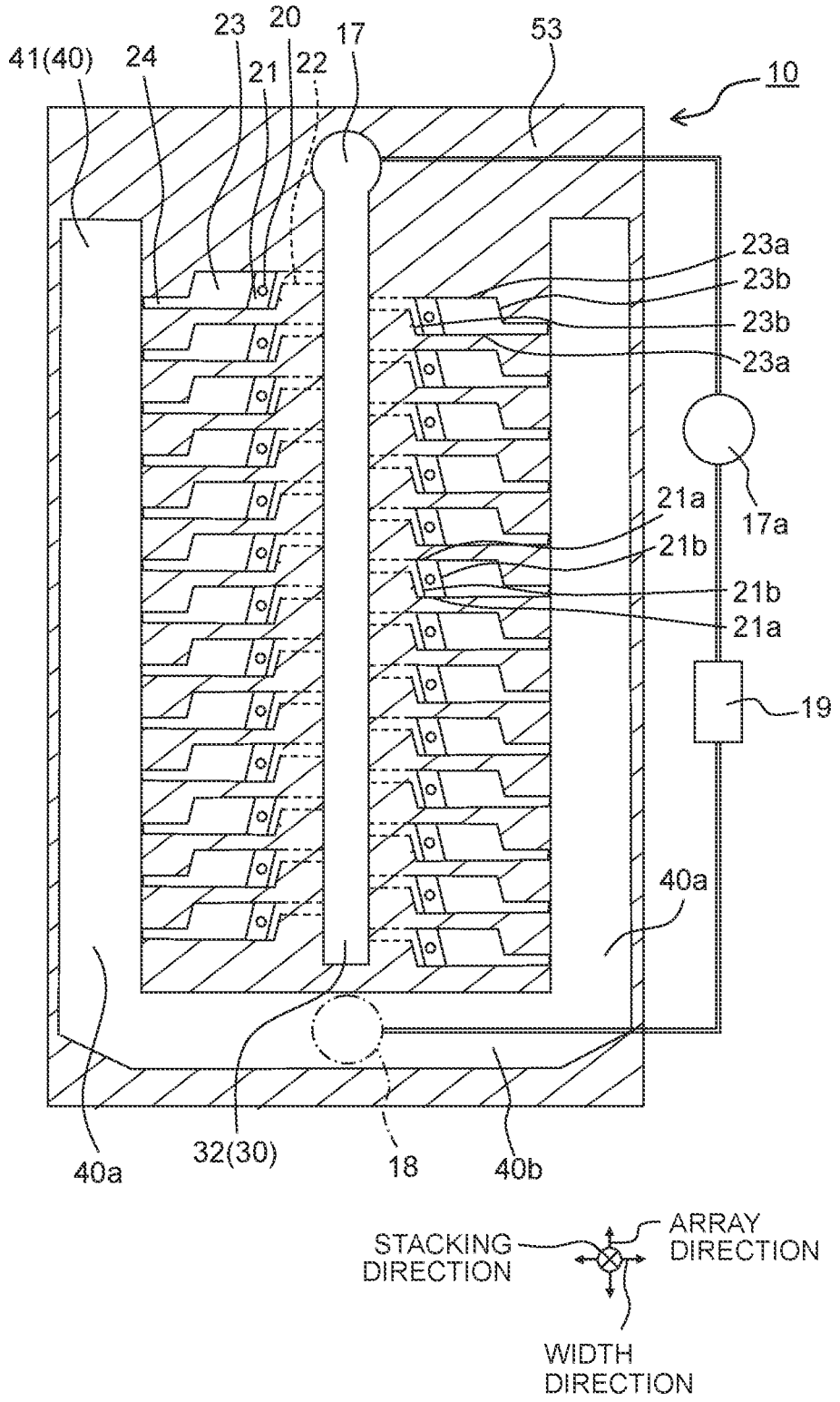
FIG. 3 is a partial cross-sectional view of the head cut along the line of FIG. 2.

As depicted in FIGS. 2 and 3, the head 10 includes a channel formation member 50 formed with channels in communication with the nozzles 20 for the liquid to flow therethrough, piezoelectric elements 70, and a driving unit 80. Note that the upper side refers to the side of the piezoelectric elements 70 above the side of the nozzles 20, while the lower side refers to the opposite side. However, the head 10 is not limited to such arrangement direction.

The channel formation member 50 has a nozzle plate 51, a communication plate 52, a pressure chamber plate 53, an accommodation plate 54, and a damper plate 55. These plates are stacked in the above order and joined together with an adhesive or the like. The direction of stacking those plates (the stacking direction) is orthogonal to the array direction and the width direction. Each plate and the damper plate 55 have, for example, a flat-plate shape. Each plate and the damper plate 55 are formed of a metallic material such as stainless steel, silicon, ceramics, or a synthetic resin material such as polyimide or the like.

The nozzle plate 51 is provided with the plurality of nozzles 20. The nozzles 20 are formed as through holes penetrating through the nozzle plate 51 in the stacking direction. The lower surface of the nozzle plate 51 forms the nozzle surface where the nozzles 20 open.

The communication plate 52 is longer than the nozzle plate 51 respectively along the stacking direction and the width direction. The communication plate 52 is provided with descenders 21, discharge individual channels 22, and a first discharge portion 31 of a discharge common channel 30. For example, the descenders 21 and the discharge individual channels 22 are provided at the same number as the nozzles 20, and arrayed along the nozzle arrays 20*a* (see FIG. 1). On the other hand, one discharge common channel 30 is provided between the two nozzle arrays 20*a* along the width direction, extending in the array direction, its one end being connected to a discharge tube 17. Through the discharge common channel 30, the liquid flows from the other end toward the one end. Therefore, the other end may be referred to as the upstream side whereas the one end as the downstream side as for the discharge common channel 30.

The descenders 21 are channels in communication with the nozzles 20, and penetrate through the communication plate 52 to overlap with the nozzles 20 along the stacking direction. The plurality of descenders 21 are arranged to interpose the discharge common channel 30 along the width direction, and formed as staggered in the array direction.

The discharge individual channels 22 are channels provided for joining the first discharge portion 31 of the one discharge common channel 30 from the plurality of descenders 21, and are arranged between the descenders 21 and the first discharge portion 31 along the width direction, extending in the width direction to render communication between the same. The discharge individual channels 22 open in the lower surface of the communication plate 52 and sink in therefrom, and the opening portions are formed to be covered by the nozzle plate 51. The plurality of discharge individual channels 22 are arranged to interpose the discharge common channel 30 along the width direction, and formed as staggered in the array direction.

The first discharge portion 31 penetrates through the communication plate 52 along the stacking direction, opens in the lower surface of the communication plate 52, and the opening portion is covered by the nozzle plate 51. The first discharge portion 31 is provided between two discharge individual channels 22 aligning in the width direction to extend in the array direction longer than the range of the discharge individual channels 22 arranged to align in the array direction. The first discharge portion 31 is rectangular in the cross section orthogonal to the array direction.

The pressure chamber plate 53 is sized the same as the communication plate 52 along the array direction and the width direction, and sized the same as or larger than the communication plate 52 along the stacking direction. The pressure chamber plate 53 is provided with a second discharge portion 32 of the discharge common channel 30, pressure chambers 23, supply individual channels 24, and first supply portions 41 of a supply common channel 40. Those members are arranged to interpose the second discharge portion 32 between two pressure chambers 23, further interpose the former members between two supply individual channels 24, and further interpose all of the former members between two first supply portions 41, along the width direction. For example, the pressure chambers 23 and the supply individual channels 24 are provided at the same number as the nozzles 20 whereas only one supply common channel 40 is provided.

The plurality of pressure chambers 23 are arrayed along the array direction at intervals, and each of the pressure chambers 23 is arranged between the second discharge portion 32 and the supply individual channel 24. The pressure chambers 23 are formed to sink in from the lower surface of the pressure chamber plate 53, and such part of the pressure chamber plate 53 as left above the pressure chambers 23 is used as a vibration-plate portion 56.

Note that in the above description, the vibration-plate portion 56 is provided integrally with the pressure chamber plate 53 as part of the pressure chamber plate 53. However, the vibration-plate portion 56 may be provided as another member than the pressure chamber plate 53. In such cases, the pressure chambers 23 may be formed to penetrate through the pressure chamber plate 53 along the stacking direction, and the vibration-plate portion 56 may be stacked on the upper surface of the pressure chamber plate 53. The pressure chambers 23 are sized, for example, from 60 μm to 80 μm along the stacking direction.

The pressure chambers 23 open in the lower surface of the pressure chamber plate 53. The pressure chambers 23 are in communication with the descenders 21 via parts of the opening portions, and are arranged to overlap with the descenders 21 along the stacking direction. The other parts of the opening portions are covered by the communication plate 52. The descenders 21 are arranged in the closer to the second discharge portion 32 than to the first supply portions 41 with respect to the pressure chambers 24 along the width direction.

The pressure chambers 23 have a parallelogram shape on the cross section orthogonal to the stacking direction. This parallelogram has a pair of first sides 23*a* and a pair of second sides 23*b*. The first sides 23*a* extend in the width direction while the second sides 23*b* are inclined with respect to the second discharge portion 32 extending in the array direction such that the farther downstream (to the side of the discharge tube 17), the closer to the second discharge portion 32.

The descenders 21 in communication with the pressure chambers 23 also have a parallelogram shape having a pair of third sides 21*a* and a pair of fourth sides 21*b*. The third sides 21*a* extend in the width direction and in continuation with the first sides 23*a* of the pressure chambers 23 while the fourth sides 21*b* are inclined in the same manner as the second sides 23*b* of the pressure chambers 23. Along the width direction, the pair of fourth sides 21*b* are arranged between the pair of second sides 23*b*, and the length between the pair of fourth sides 21*b* is smaller than the length between the pair of second sides 23*b*.

The supply individual channels 24 are channels for branching from the one supply common channel 40 to the plurality of pressure chambers 23, and are arranged between the first supply portions 41 of the supply common channel 40 and the pressure chambers 23 along the width direction, extending in the width direction for communication with those members. The supply individual channels 24 are formed to sink in from the lower surface of the pressure chamber plate 53, and open in the lower surface of the pressure chamber plate 53. The supply individual channels 24 are channels in communication with the pressure chambers 23, are formed to sink in from the lower surface of the pressure chamber plate 53, and open in the lower surface of the pressure chamber plate 53. The opening portions are covered by the communication plate 52. The supply individual channels 24 are connected to the pressure chambers 23 in upstream portions along the array direction and arranged at the upstream side from the discharge individual channels 22 along the array direction.

The first supply portions 41 penetrate through the pressure chamber plate 53 along the stacking direction, open in the lower surface of the pressure chamber plate 53, and the opening portions are covered by the communication plate 52. The first supply portions 41 extend in the array direction.

The second discharge portion 32 is formed to sink in from the lower surface of the pressure chamber plate 53 and opens in the lower surface of the pressure chamber plate 53. According to that, no other part needs to be prepared to cover the upper side of the second discharge portion 32 and, for example, it is possible to form the second discharge portion 32 easily by way of half-etching.

The second discharge portion 32 is in communication with the first discharge portion 31, overlapping with the first discharge portion 31 in the stacking direction, while extending in the array direction along which the plurality of pressure chambers 23 align, between two pressure chambers 23 aligning in the width direction, in the same manner as the first discharge portion 31. The second discharge portion 32 is rectangular in the cross section orthogonal to the array direction. The first discharge portion 31 and the second discharge portion 32 are in communication with the plurality of pressure chambers 23 through the descenders 21 and the discharge individual channels 22, to form the discharge common channel 30 to discharge the liquid from the plurality of pressure chambers 23.

The part of the pressure chamber plate 53 left above the second discharge portion 32 is sized equal to the vibration-plate portion 56 left above the pressure chambers 23 along the stacking direction. Therefore, the second discharge portion 32 is sized equal to the pressure chambers 23 along the stacking direction. By virtue of this, for example, by eliminating the pressure chamber plate 53 from below by way of etching or the like, it is possible to form the second discharge portion 32 together with the pressure chambers 23 through the same process. Note that the term "equal" is a concept including an allowable error such as manufacturing error or the like (for example, plus or minus 5%).

The upper surface of the second discharge portion 32 at the far side from the first discharge portion 31 is at the same position as the upper surfaces of the pressure chambers 23 at the far side from the descenders 21, along the stacking direction. On the vibration-plate portion 56 covering the upper side of the pressure chambers 23, the piezoelectric elements 70 are arranged in positions overlapping with the pressure chambers 23 along the stacking direction, such that the second discharge portion 32 reaches as high as to the surfaces of the pressure chambers 23 on the side of the piezoelectric elements 70 along the stacking direction. By virtue of this, the discharge common channel 30 is expanded in the cross-sectional area orthogonal to the array direction.

The accommodation plate 54 is sized the same as the pressure chamber plate 53 along the array direction and the width direction. The accommodation plate 54 is provided with accommodation portions 57, first hollow portions 58, and second supply portions 42 of the supply common channel 40. These members are arranged to interpose the one first hollow portion 58 between two accommodation portions 57 along the width direction, and interpose the accommodation portions 57 between two second supply portions 42.

The accommodation portions 57 are sized equal to the pressure chambers 23 along the width direction, being 500 μm, for example. The accommodation portions 57 are arranged to overlap with the pressure chambers 23 along the stacking direction, and extend through a long distance along the array direction. The accommodation portions 57 are formed to sink in from the lower surface of the accommodation plate 54 along the stacking direction. The piezoelectric elements 70 are arranged inside the accommodation portions 57 and the accommodation plate 54 covers the piezoelectric elements 70.

The piezoelectric elements 70 are constructed from a common electrode, piezoelectric bodies, and individual electrodes. The common electrode is provided commonly for the plurality of piezoelectric elements 70, and stacked on the vibration-plate portion 56 to cover the entire upper surface of the vibration-plate portion 56. The common electrode is connected to a common lead wire (not depicted). Note that an insulating film (not depicted) may cover the upper surface of the vibration-plate portion 56, and the common electrode may be arranged on the upper surface of the vibration-plate portion 56 via the insulating film. Further, the vibration-plate portion 56 may be formed integrally with the common electrode.

One piezoelectric body is provided for each pressure chamber 23, and arranged on the pressure chamber 23 via the vibration-plate portion 56 and the common electrode. The individual electrodes are arranged on the piezoelectric bodies, respectively. The individual electrodes are connected with individual lead wires 71 which are drawn out from the accommodation portions 57 to the first hollow portions 58 along the width direction.

If a voltage is applied to a certain individual electrode, then the corresponding piezoelectric body deforms such that the vibration-plate portion 56 displaces in accordance with that. With the vibration-plate portion 56 displacing toward the pressure chamber 23, the pressure chamber 23 decreases in volume such that a pressure is applied to the liquid inside the pressure chamber 23, so as to discharge the liquid from the nozzle 20 in communication with the pressure chamber 23.

The first hollow portions 58 are arranged to overlap with the discharge common channel 30 along the stacking direction to extend through a long distance along the array direction, and formed to penetrate through the accommodation plate 54 along the stacking direction. The vibration-plate portion 56 covers the opening portions of the first hollow portions 58 in the lower surface of the accommodation plate 54. A driving unit 80 is arranged on the vibration-plate portion 56 inside the first hollow portions 58. Further, the upper surface of the accommodation plate 54 opens via the first hollow portions 58. Because the driving unit 80 is exposed through the opening portions, it is possible to connect the same with an external device such as a controller or the like.

The driving unit 80 is, for example, a driver IC such as a semiconductor chip or the like to drive the piezoelectric elements 70, and is mounted on a film-like substrate 81. The film-like substrate 81 is, for example, a flexible printed circuit (FPC) which is made of polyimide or the like being thin and flexible, to construct a COF 82 (Chip On Film) mounted with the driving unit 80. One end of the film-like substrate 81 is connected electrically to an individual lead wires 71 or the common lead wire extending from the piezoelectric elements 70 to the first hollow portions 58, while the other end of the film-like substrate 81 is connected to a controller (not depicted). By virtue of this, the driving unit 80 converts a control signal from the controller to a drive signal for the piezoelectric elements 70 and outputs the same, so as to control the driving of the piezoelectric elements 70. Note that the driving unit 80 may be mounted on a rigid substrate.

The second supply portions 42 penetrate through the accommodation plate 54 in the stacking direction, open in the upper surface of the accommodation plate 54. A damper film 60 is attached thereto to cover the opening portions. The damper film 60 is a flexible film-like member whose deformation serves to constrain pressure variation of the liquid in the supply common channel 40.

The damper film 60 is covered by the damper plate 55. The damper plate 55 is sized the same as the accommodation plate 54 along the array direction and the width direction. The damper plate 55 is provided with a hollow portion (a second hollow portion 59) and two damper portions 61. Along the width direction, the two damper portions 61 are arranged to interpose the second hollow portion 59 therebetween.

The second hollow portion 59 is arranged to overlap with the first hollow portions 58 and the accommodation portions 57 along the stacking direction, extending through a long distance along the array direction, and formed to penetrate through the damper plate 55 along the stacking direction. The COF 82 is exposed to the outside via the first hollow portions 58 and the second hollow portion 59.

The damper portion 61 is formed to sink in from the lower surface of the damper plate 55 and to open in the lower surface. The damper plate 55 is arranged such that the damper portion 61 may overlap with the second supply portion 42 along the stacking direction, and is fixed on the periphery of the damper film 60. By virtue of this, the damper plate 55 is covered and protected by the damper film 60.

The second supply portion 42 opens in the lower surface of the accommodation plate 54, in communication with the first supply portion 41 through that opening portion. The first supply portion 41 and the second supply portion 42 constitute the supply common channel 40 for supplying the liquid to the plurality of pressure chambers 23 via the supply individual channels 24.

The supply common channel 40 is formed into a U-shape as viewed from above, as depicted in FIG. 3, having a pair of first portions **40*a* extending in the array direction, and a second portion 40*b* extending in the width direction. Each (upper) end of the pair of first portions 40*a* is connected with the second portion 40*b*. The second portion 40*b* is connected to one end of a supply tube 18 at the center position along the width direction while the other end of the supply tube 18** is connected to a tank 19. The tank 19 is further connected to the discharge tube 17 which is provided with a pump 17*a*.

Due to the pump 17*a*, the liquid flows through the discharge tube 17 and the discharge common channel 30 connected thereto and flows on into the tank 19. The liquid in the tank 19 then flows through the supply tube 18 and flows on into the second portion 40*b* of the supply common channel 40 connected thereto and, furthermore, branches from the second portion 40*b* to flow into the pair of first portions 40*a*. Then, the liquid is distributed from the first portions 40*a* to the plurality of pressure chambers 23 via the plurality of supply individual channels 24, and flows from the pressure chambers 23 into the descenders 21. Part of the liquid in the descenders 21 flows to the nozzles 20 and the rest of the liquid is discharged to the discharge common channel 30 via the discharge individual channels 22.

The discharge common channel 30 is expanded in the stacking direction by the second discharge portion 32 positioned as high as up to the surface of the pressure chambers 23 at the side of the piezoelectric elements 70. Therefore, the resistance is lessened against the liquid flowing through the discharge common channel 30 so as to reduce the difference in the flow speed for the plurality of pressure chambers 23 along the flow direction and in communication with the discharge common channel 30. By virtue of this, between the plurality of nozzles 20 in respective communication with the plurality of pressure chambers 23, over the passage of time, because variations are lowered respectively in the liquid viscosity in the nozzles 20 and in the speed and quantity of the droplets discharged from the nozzles 20, it is possible to facilitate improvement in the liquid discharge features.

First Modified Embodiment

Figure 4A:
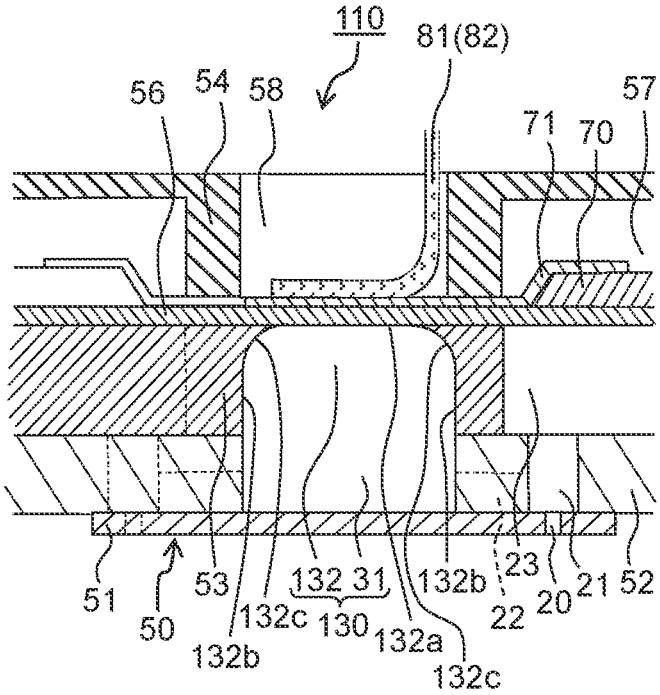
FIG. 4A is a schematic view of part of a head according to a first modified embodiment of the present disclosure.

In a head 110 according to a first modified embodiment based on the first embodiment, as depicted in FIG. 4A, a second discharge portion 132 of a discharge common channel 130 may have an corner-portion curved between a surface intersecting the width direction and surfaces intersecting the stacking direction.

For example, the second discharge portion 132 is enclosed circumferentially in the pressure chamber plate 53 by a surface (the upper surface 132*a*) intersecting the stacking direction (being orthogonal thereto for example), a pair of surfaces (the lateral surfaces 132*b*) intersecting the width direction (being orthogonal thereto for example), and a pair of surfaces (the end surfaces) intersecting the array direction (being orthogonal thereto for example). The corner-portion 132*c* between the upper surface 132*a* and the lateral surfaces 132*b* is formed by a curved surface chamfered into an arc-like shape curved at a cross section along the array direction. Because bubbles in the liquid smoothly flow along the corner-portion 132*c* in such a curved shape, it is possible to prevent the bubbles from being detained in the second discharge portion 132, so as to suppress the liquid discharge defects due to the bubbles.

Second Modified Embodiment

Figure 4B:
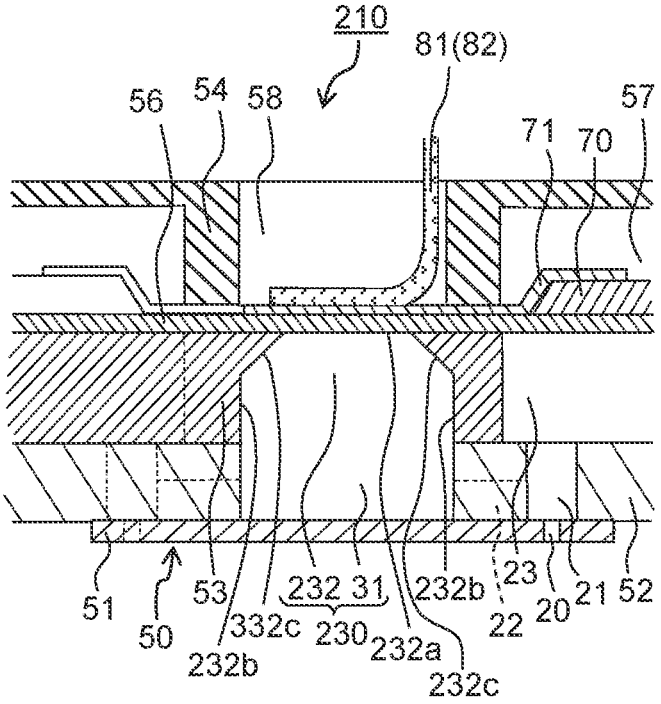
FIG. 4B is a schematic view of part of a head according to a second modified embodiment of the present disclosure.

In a head 210 according to a second modified embodiment based on the first embodiment, as depicted in FIG. 4B, a second discharge portion 232 of a discharge common channel 230 may have an corner-portion inclined between a surface intersecting the width direction and surfaces intersecting the stacking direction.

For example, the second discharge portion 232 is enclosed circumferentially in the pressure chamber plate 53 by an upper surface 232*a*, a pair of lateral surfaces 232*b*, and a pair of end surfaces. The corner-portion 232*c* between the upper surface 232*a* and the lateral surfaces 232*b* is formed by an inclined surface chamfered into an oblique line inclined with respect to the upper surface 232*a* and the lateral surfaces 232*b* at a cross section along the array direction. Because bubbles in the liquid smoothly flow along the corner-portion 232*c* in such an inclined shape, it is possible to prevent the bubbles from being detained in second discharge portion 232, so as to suppress the liquid discharge defects due to the bubbles.

Third Modified Embodiment

Figure 5:
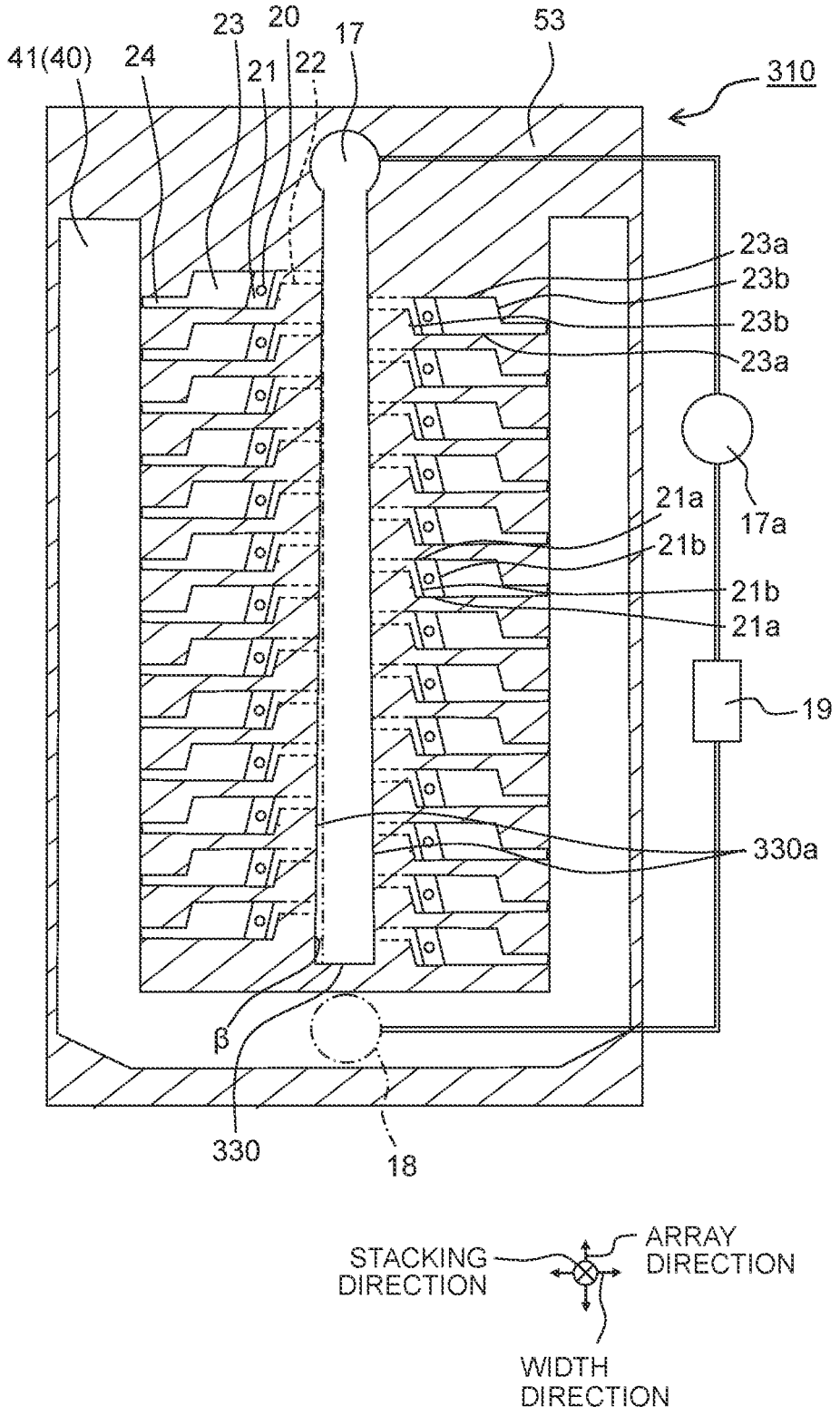
FIG. 5 is a schematic view of part of a head according to a third modified embodiment of the present disclosure.

In a head 310 according to a third modified embodiment based on the first embodiment, as depicted in FIG. 5, the farther downstream, the smaller a discharge common channel 330 is sized along the width direction. That is, the discharge common channel 330 has a pair of surfaces (opposite surfaces 330*a*) facing each other along the width direction. The pair of opposite surfaces 330*a* are inclined with respect to the symmetrical line at a certain angle β along the array direction such that the farther downstream, the smaller the interval therebetween. For example, because it is possible to upsize the discharge common channel 330 by the length of the discharge individual channels 22 along the width direction, in the discharge common channel 330 sized 30 mm along the array direction, the angle β of the opposite surfaces 330*a* is 89 degrees or less.

By virtue of this, the farther downstream, the larger the resistance against the liquid flow in the discharge common channel 330. Hence, between upstream and downstream in the discharge common channel 330, it is possible to lessen the difference in the flow speed of the liquid flowing through the discharge individual channels 22 connected to the discharge common channel 330, thereby facilitating improvement of the liquid discharge features.

Note that in the discharge common channel 330, both the first discharge portion 31 and the second discharge portion 32 may be downsized along the width direction as toward the downstream side. Alternatively, in the discharge common channel 330, the first discharge portion 31 may be downsized along the width direction as toward the downstream side while the second discharge portion 32 be sized constant along the width direction without changing along the array direction. Still alternatively, in the discharge common channel 330, the second discharge portion 32 may be downsized along the width direction as toward the downstream side while the first discharge portion 31 be sized constant along the width direction without changing along the array direction.

Further, in the third modified embodiment, in the same manner as the first modified embodiment, the corner-portion of the second discharge portion 32 may be curved. Further, in the third modified embodiment, in the same manner as the second modified embodiment, the corner-portion of the second discharge portion 32 may be inclined.

Second Embodiment

Figure 6:
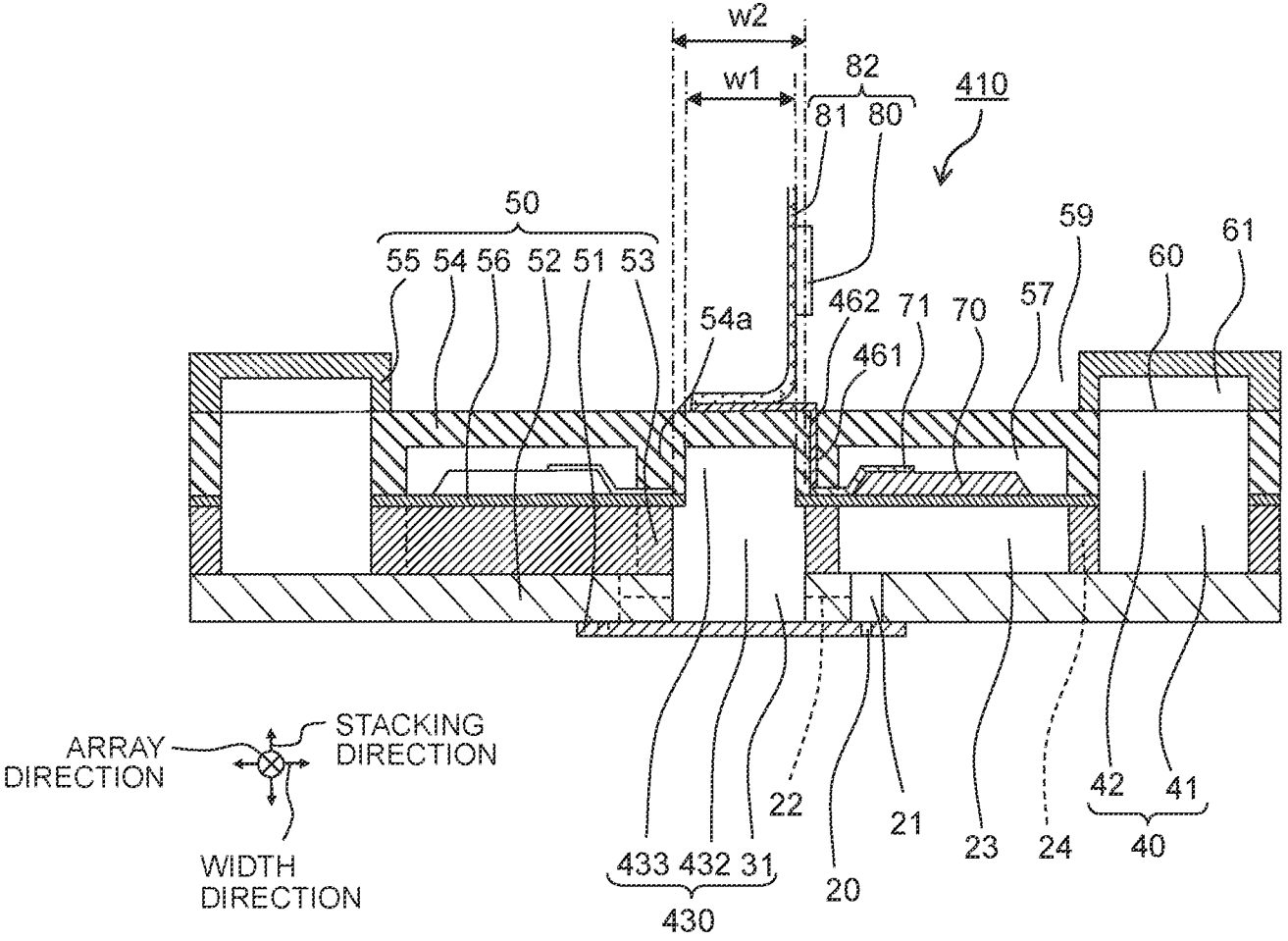
FIG. 6 is a schematic view of part a head according to a second embodiment of the present disclosure.

In a head 410 according to a second embodiment of the present disclosure, as depicted in FIG. 6, the shape of a discharge common channel 430, the shape of the accommodation plate 54, and the position of the COF 82 are different from those in the first embodiment. The other aspects are all the same as the head 10 according to the first embodiment, and hence explanations for the configuration, functions and effects are omitted.

<Head>

A second discharge portion 432 of the discharge common channel 430 is formed to penetrate through the pressure chamber plate 53 and open respectively in the upper surface and the lower surface of the pressure chamber plate 53. The second discharge portion 432 is in communication with the first discharge portion 31 via the opening portion in the lower surface of the pressure chamber plate 53, and overlaps with the first discharge portion 31 along the stacking direction. Further, the upper end of the second discharge portion 432 is positioned above the upper surface of the pressure chambers 23 along the stacking direction.

The discharge common channel 430 is formed in the accommodation plate 54 and further has a third discharge portion 433 in communication with the second discharge portion 32. The third discharge portion 433 is formed to sink in from the lower surface of the accommodation plate 54 and open in the lower surface of the accommodation plate 54. According to that, for example, it is possible to form the third discharge portion 433 easily by way of half-etching.

The third discharge portion 433 is sized smaller than the second discharge portion 432 along the width direction, and is arranged to overlap with the second discharge portion 432 along the stacking direction, with its center in alignment with the center of the second discharge portion 432 along the stacking direction. For example, along the width direction, the size w1 of the third discharge portion 433 is from 300 μm to 400 μm whereas the size w2 of the second discharge portion 432 is from 400 μm to 500 μm. Further, along the width direction, the size w1 of the third discharge portion 433 is equal to the size of the contact points of the COF 82. Note that the term "equal" is a concept including an allowable error such as manufacturing error or the like (for example, plus or minus 5%).

Therefore, it is possible to upsize the part (a wall 54*a*) between the accommodation portions 57 and the third discharge portion 433 in the accommodation plate 54, as compared to the case where the third discharge portion 433 is sized as equal to the second discharge portion 432 along the width direction. Hence, even though the COF 82 is disposed on the accommodation plate 54 to overlap with the third discharge portion 433, it is still possible to restrain the accommodation plate 54 from decreasing in endurance due to the weight of the COF 82.

The third discharge portion 433 is in communication with the second discharge portion 432 through the opening portion in the lower surface of the accommodation plate 54. In the same manner as the first discharge portion 31 and the second discharge portion 432, the third discharge portion 433 extends along the array direction in which the plurality of accommodation portions 57 align, between two accommodation portions 57 aligning in the width direction.

The first discharge portion 31, second discharge portion 432 and third discharge portion 433 are formed integrally to constitute the discharge common channel 430. Due to the third discharge portion 433, the discharge common channel 430 is further expanded such that the resistance is lessened against the liquid flowing through the discharge common channel 430 so as to reduce the difference in the flow speed for the plurality of pressure chambers 23 in communication therewith. Hence, between the plurality of nozzles 20 in respective communication with the plurality of pressure chambers 23, variations are lowered respectively in the liquid viscosity and in the speed and quantity of the droplets discharged, such that it is possible to facilitate improvement in the liquid discharge features.

The upper surface of the third discharge portion 433 at the far side from the second discharge portion 432 is positioned at the same level as the upper surface of the accommodation portions 57 at the far side from the pressure chambers 23 along the stacking direction. Hence, the third discharge portion 433 is sized equal to the accommodation portions 57 along the stacking direction. For example, if the piezoelectric elements 70 are sized from 1 μm to 2 μm and the flexure of accommodation portions 57 is sized from 20 μm to 30 μm along the stacking direction, then the accommodation portions 57 are sized as 100 μm. According to that, for example, by eliminating the accommodation plate 54 from below by way of etching or the like, it is possible to form the third discharge portions 433 together with the accommodation portions 57 through the same process. Note that the term "equal" is a concept including an allowable error such as manufacturing error or the like (for example, plus or minus 5%).

The accommodation plate 54 is provided with the accommodation portions 57, the third discharge portion 433 of the discharge common channel 430, and the second supply portion 42 of the supply common channel 40. Those members are arranged to interpose the third discharge portion 433 between two accommodation portions 57, and interpose the whole between two supply common channels 40.

In this manner, the accommodation plate 54 is formed with the third discharge portion 433 instead of the first hollow portions 58. Therefore, the upper surface of the accommodation plate 54 appears to the outside via the second hollow portion 59 of the damper plate 55, and the COF 82 is arranged there. The COF 82 is connectable with an external device via the second hollow portion 59.

The accommodation plate 54 is provided further with a plurality of through holes 461 penetrating therethrough along the stacking direction, and pass-through electrodes 462 arranged in the through holes 461. The through holes 461 are provided between the accommodation portions 57 and the third discharge portion 433 along the width direction, and open respectively in the upper surface and the lower surface of the accommodation plate 54. The individual lead wires 71 and the common lead wire are arranged to face the opening portions in the lower surface, extending from the piezoelectric elements 70.

The pass-through electrodes 462 are made of a metal such as copper or the like and a coating process or the like may be performed on the surface. The pass-through electrodes 462 are connected to the individual lead wires 71 with their lower ends coming out of the opening portions below the through holes 461 after passing through the through holes 461. Further, the pass-through electrodes 462 coming out of the upper opening portions of the through holes 461 are connected to the COF 82 extending in the width direction on the upper surface of the accommodation plate 54. By virtue of this, the COF 82 is connected electrically to the individual electrodes of the piezoelectric elements 70 via the pass-through electrodes 462 and the individual lead wires 71. Further, the COF 82 is arranged on the upper surface of the accommodation plate 54 to overlap with the third discharge portion 433 along the stacking direction, being connected electrically thereto via the pass-through electrodes 462 and the common lead wire. In this manner, due to the pass-through electrodes 462, it is possible for the pass-through electrodes 462 to easily connect the driving unit 80 on the accommodation plate 54 and the piezoelectric elements 70 in the accommodation portions 57 of the accommodation plate 54.

<Method for Manufacturing the Head>

Figure 7A:
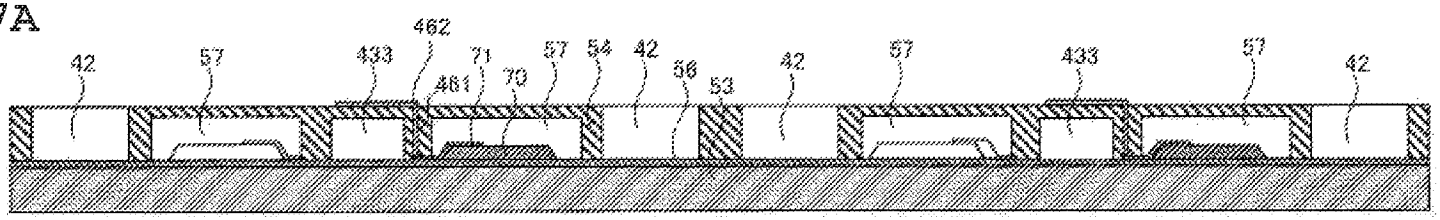
FIGS. 7A to 7D are views for explaining a manufacturing method for the head of FIG. 6.

As depicted in FIG. 7A, in a method for manufacturing the head 410, one processing part is set to constitute the head 410 in the accommodation plate 54 along the width direction, grouping the third discharge portion 433, a pair of accommodation portions 57 interposing the former member therebetween, a pair of second supply portions 42 interposing the immediately former members, and the through holes 461 between one of the pair of accommodation portions 57 and the third discharge portion 433. Note that the one processing part may include other processing parts than the above.

Then, a plurality of processing parts are formed to align in the width direction by a processing method such as etching or the like performed on the accommodation plate 54. By virtue of this, it is possible to easily form the third discharge portion 433 and the accommodation portions 57 through the same process. Further, the second supply portion 42 is formed in another process than the above and, in still another process, the through holes 461 are formed.

Here, the part from the lower surface of the accommodation plate 54 to the upper surface of the accommodation portions 57 is sized equal to the part the lower surface of the accommodation plate 54 to the upper surface of the third discharge portion 433. Therefore, if the accommodation portions 57 and the third discharge portion 433 are formed to sink in from the lower surface of the accommodation plate 54 by way of half etching, then because the processing time is equal to each other, it is possible to easily form those members.

The pass-through electrodes 462 are arranged to pass through the through holes 461, and extend on the upper surface of the accommodation plate 54 to the upper side of the third discharge portion 433. Then, the accommodation plate 54 is stacked on the pressure chamber plate 53 and joined thereto with an adhesive or the like to accommodate the piezoelectric elements 70 in the accommodation portions 57 and to connect the pass-through electrodes 462 to the lead wires drawn out from the piezoelectric elements 70. Here, the pressure chamber plate 53 is arranged such that the piezoelectric elements 70 may be disposed on the vibration-plate portion 56 of the pressure chamber plate 53.

Figure 7B:
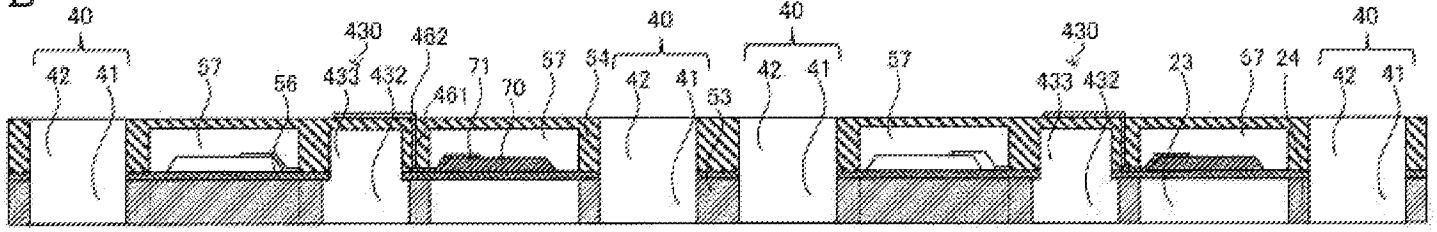

Next, as depicted in FIG. 7B, the first supply portions 41, the pressure chamber 23, the second discharge portion 432, and the supply individual channel 24 are formed as one processing part in the pressure chamber plate 53 to constitute the head 410, by a processing method such as etching or the like performed on the pressure chamber plate 53. Here, along the stacking direction, the second supply portions 42 overlap in communication with the first supply portions 41, the pressure chamber 23 overlaps in communication with the accommodation portions 57, the second discharge portion 432 overlaps in communication with the third discharge portion 433, and the supply individual channel 24 overlaps in communication with the pressure chamber 23, the first supply portions 41 and the supply individual channel 24. In this manner, it is possible to easily form the first supply portions 41, the pressure chamber 23, the second discharge portion 432 and the supply individual channel 24 through the same process.

Figure 7C:
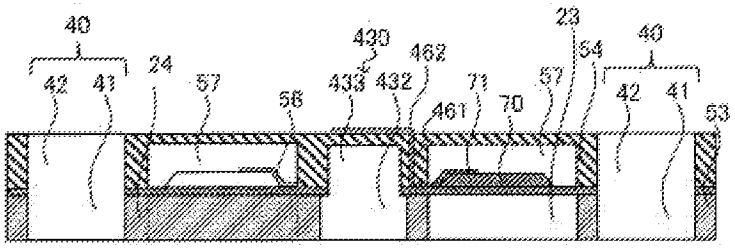

In this way, the accommodation plate 54 and the pressure chamber plate 53 are joined into one body to form a plurality of processing parts, respectively. As depicted in FIG. 7C, the accommodation plate 54 and the pressure chamber plate 53 are cut up at each part. By virtue of this, it is possible to form the processing parts for a plurality of heads 410 more easily than to form each processing part of the accommodation plate 54 and the pressure chamber plate 53 for each one head 410.

Figure 7D:
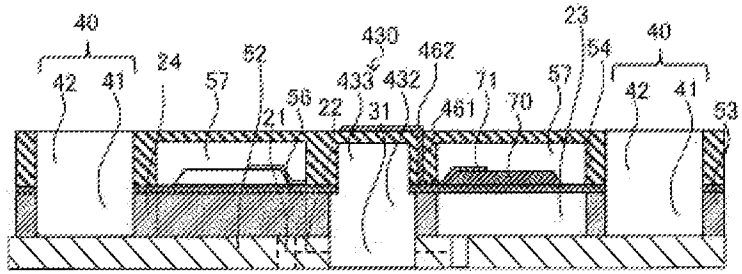

Next, as depicted in FIG. 7D, the accommodation plate 54 and pressure chamber plate 53 formed with one processing part are stacked on the communication plate 52. The communication plate 52 is formed with the descender 21, the first discharge portion 31, and the discharge individual channel 22 in communication therewith. Then, along the stacking direction, the pressure chamber plate 53 and the communication plate 52 are joined together with an adhesive or the like such that the descender 21 overlaps in communication with the pressure chamber 23, and the first discharge portion 31 overlaps in communication with the second discharge portion 432. Note that the descender 21, the first discharge portion 31 and the discharge individual channel 22 may be formed after joining the communication plate 52 and the pressure chamber plate 53.

Next, as depicted in FIG. 6, the nozzle plate 51 formed with the nozzles 20 is stacked onto the communication plate 52 and joined thereto with an adhesive or the like. Note that the nozzles 20 may be formed in the nozzle plate 51 after the joining.

Further, the COF 82 is connected electrically to the pass-through electrodes 462 extending on the upper surface of the accommodation plate 54. By virtue of this, the driving unit 80 of the COF 82 is connected electrically with the piezoelectric elements 70 with the pass-through electrodes 462 and the lead wires. Further, on the upper surface of the accommodation plate 54, the damper film 60 covers the opening portions of the second supply portions 42, and the damper plate 55 is stacked onto the accommodation plate 54 and joined thereto with an adhesive or the like such that the peripheral portion of the damper film 60 may be interposed between the damper plate 55 and the accommodation plate 54. In this manner, the head 410 is manufactured.

Note that it is also possible to manufacture the head 10 according to the first embodiment by the same manufacturing method as that of the second embodiment.

Fourth Modified Embodiment

Figure 8:
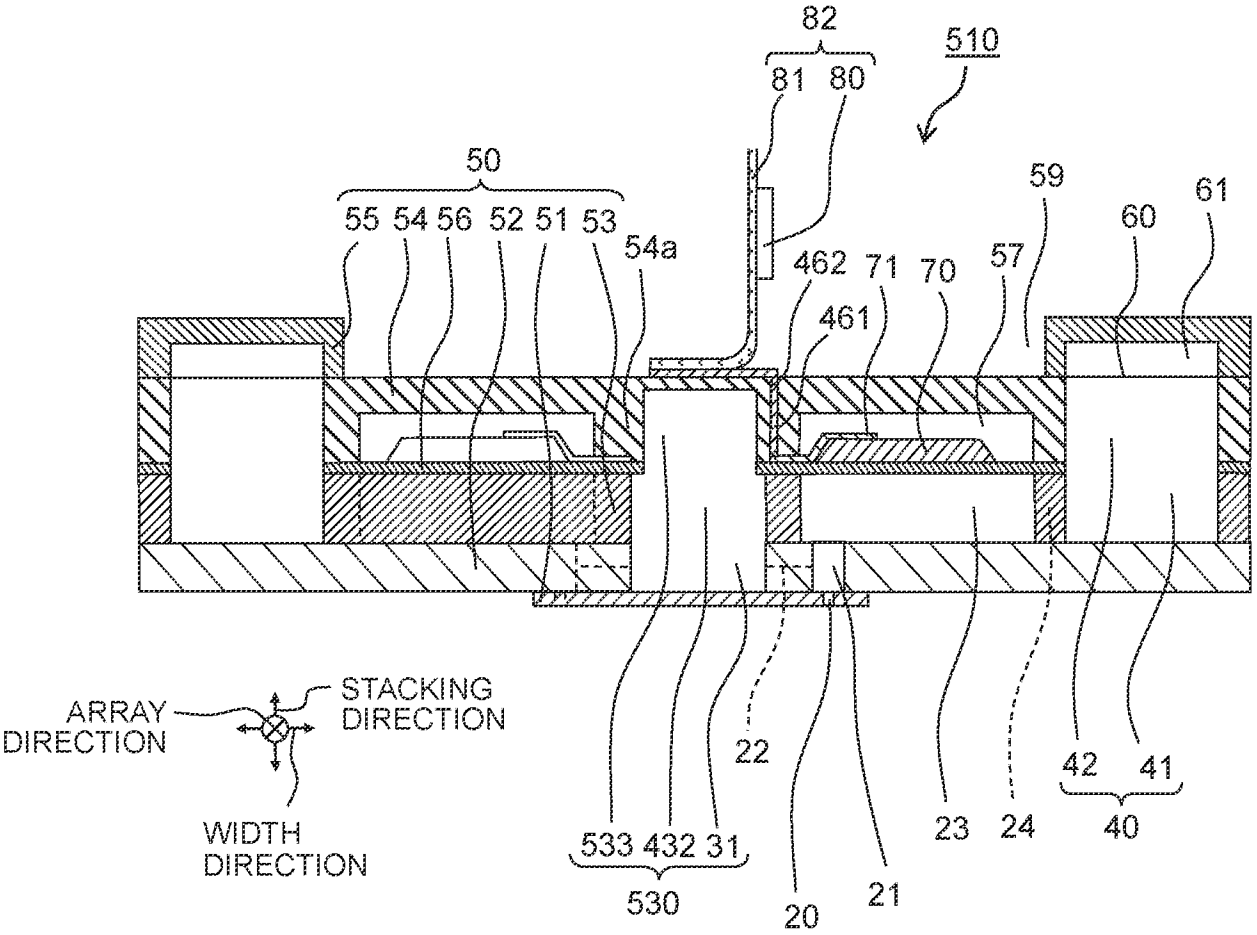
FIG. 8 is a schematic view of part of a head according to a fourth modified embodiment of the present disclosure.

As depicted in FIG. 8, in a head 510 according to a fourth modified embodiment, a third discharge portion 533 of a discharge common channel 530 may be sized larger than the accommodation portion 57 along the stacking direction.

Along the stacking direction, for example, the third discharge portion 533 is sized from not smaller than half the accommodation plate 54 to 200 μm. By virtue of this, it is possible to secure the strength for joining the COF 82 to the accommodation plate 54 above the third discharge portion 533.

The upper surface of the third discharge portion 533 is positioned above the upper surface of the accommodation portion 57 along the stacking direction at the far side from the pressure chamber plate 53. Hence, by upsizing the third discharge portion 533 to be larger than the accommodation portion 57 along the stacking direction, the discharge common channel 430 is expanded. Hence, the resistance is lessened against the liquid flowing through the discharge common channel 430 so as to reduce the difference in the resistance in the plurality of pressure chambers 23 in communication with the discharge common channel 430. Hence, variations are lowered in the droplets discharged from the nozzles 20 in communication with the pressure chambers 23, such that it is possible to facilitate improvement in the liquid discharge features.

Fifth Modified Embodiment

Figure 9:
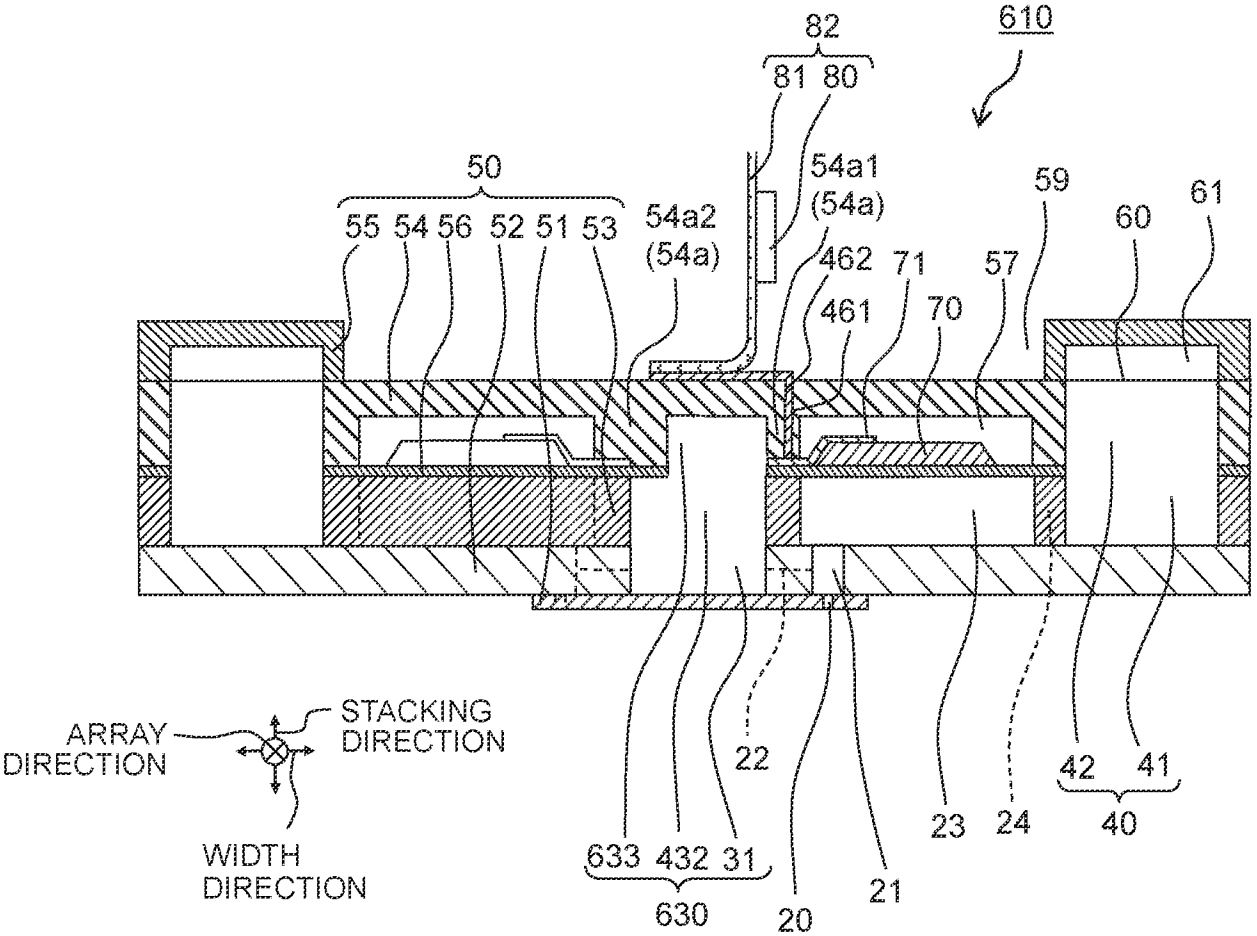
FIG. 9 is a schematic view of part of a head according to a fifth modified embodiment of the present disclosure.

In a head 610 according to a fifth modified embodiment, as depicted in FIG. 9, along the width direction, a third discharge portion 633 of a discharge common channel 630 may deviate in the center position from the second discharge portion 432. Note that along the width direction, the center of the second discharge portion 432 is defined as on the left side of the center of the third discharge portion 633 and the opposite side thereof is defined as on the right side. However, the head 610 is not limited to such arrangement.

The film-like substrate 81 of the COF 82 has one end on the left which extends along the width direction (the left/right direction) and is fixed on (the upper surface of) the accommodation plate 54 at the far side from the third discharge portion 633. The film-like substrate 81 is arranged on the third discharge portion 633 in a position to overlap with the third discharge portion 633 along the stacking direction. The film-like substrate 81 is drawn out from the fixed part to the right side in the width direction, and extends upward to bend at the right side of the accommodation portion 57 from the third discharge portion 633. The driving unit 80 is mounted on the film-like substrate 81 on the right side at the other end than the fixed part.

The third discharge portion 633 is formed such that the film-like substrate 81 may be arranged with its center at the side of the other end (at the right side) extending from the one end from the center of the second discharge portion 432 along the width direction. Along the width direction, the third discharge portion 633 is sized smaller than the second discharge portion 432 and sinks to the right of the second discharge portion 432.

The third discharge portion 633 is arranged with its center at the right side of the center between two accommodation portions 57 aligning in the width direction, being closer to the right accommodation portion 57 than the left accommodation portion 57 between the two accommodation portions 57 aligning in the width direction. Therefore, in the accommodation plate 54, the part (a right wall **54*a*1) between the third discharge portion 633 and the right accommodation portion 57 is sized smaller than the part (a left wall 54*a*2) between the third discharge portion 633 and the left accommodation portion 57. For example, the right wall 54*a*1 is sized 100 μm while the left wall 54*a*2** is sized 300 μm, along the width direction.

On the right wall **54*a*1, because the film-like substrate 81 is held upward, the junction load due to the COF 82 is smaller on the right wall 54*a*1 than on the left wall 54*a*2. In this manner, because the load acting on the right wall 54*a*1 is smaller than on the left wall 54*a*2, the right wall 54*a*1 is sized smaller along the width direction. That is, because the leading end of the COF 82 bears a larger load, the left wall 54*a*2 is sized larger than the right wall 54*a*1 along the width direction to support the leading end of the COF 82. By virtue of this, it is possible to restrain the accommodation plate 54 from decreasing in endurance due to the junction load of the COF 82**.

Sixth Modified Embodiment

Figure 10:
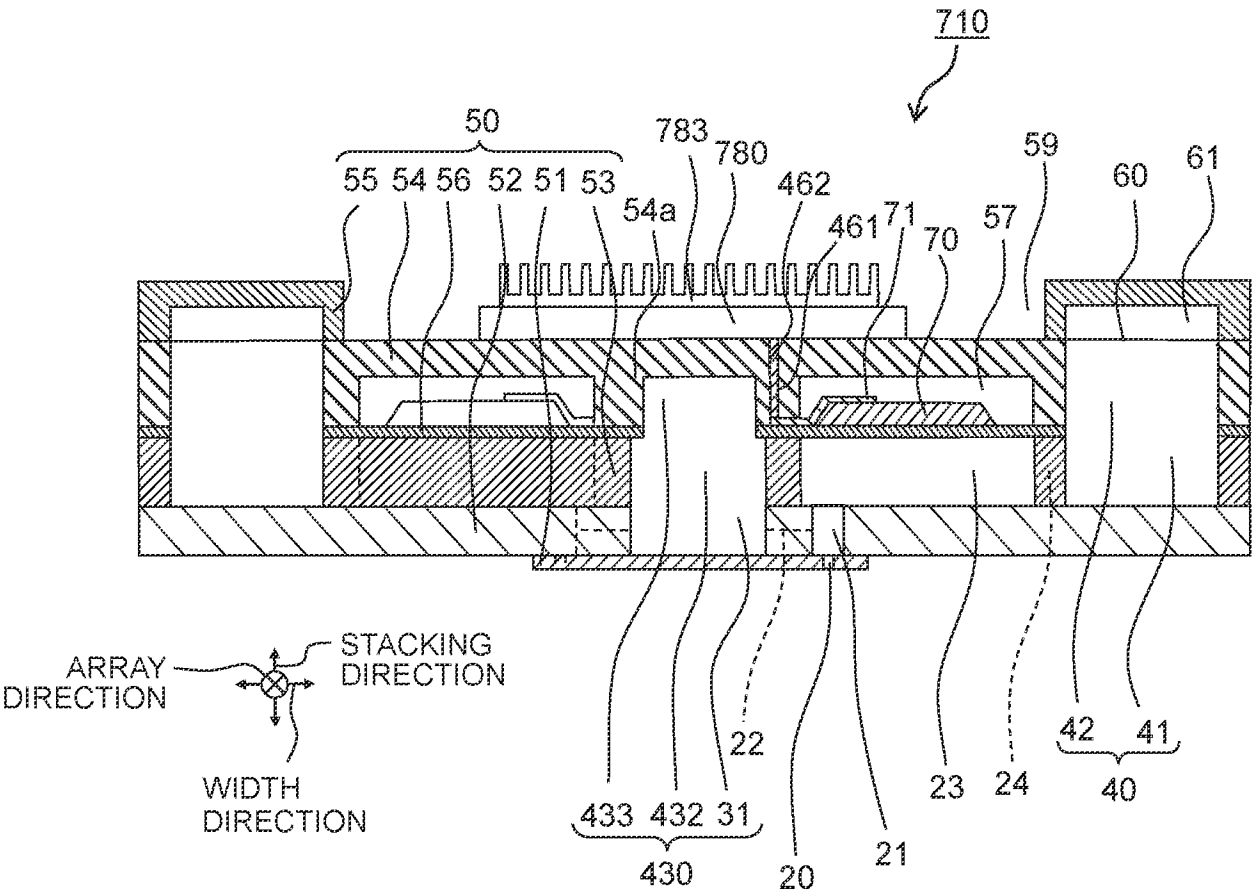
FIG. 10 is a schematic view of part of a head according to a sixth modified embodiment of the present disclosure.

As depicted in FIG. 10, a head 710 according to a sixth modified embodiment may further include a driving unit 780 arranged on (the upper surface of) the accommodation plate 54 at the far side from the third discharge portion 433. In this case, the third discharge portion 433 may be sized smaller than the driving unit 780 (for example, 1000 μm) along the width direction.

In particular, the driving unit 780 is an electronic member shaped into a flat plate, for example, to function as a driver circuit for driving the piezoelectric elements 70. The driving unit 780 is arranged on the upper surface of the accommodation plate 54 to overlap with the third discharge portion 433 and the two accommodation portions 57 interposing the same therebetween along the width direction. A terminal of the driving unit 780 is not only connected electrically to the piezoelectric elements 70 via the pass-through electrodes 462 but also connected electrically to an external device via a cable (not depicted).

Along the width direction, the driving unit 780 is sized larger than the third discharge portion 433. Therefore, the driving unit 780 is arranged on such a part of the accommodation plate 54 as between the accommodation portion 57 and the third discharge portion 433 (the wall **54*a*). Hence, because the wall 54*a* supports the driving unit 780, even though the third discharge portion 633 is formed in the accommodation plate 54, it is still possible for the accommodation plate 54** to maintain the endurance.

A heat sink 783 may be installed in the driving unit 780. The heat sink 783 is a heat dissipator covering the upper surface of the driving unit 780 at the far side from the accommodation plate 54, so as to dissipate the heat of the driving unit 780. The driving unit 780 and the heat sink 783 are arranged in the second hollow portion 59 of the damper plate 55.

An adhesive is used to attach the heat sink 783 to the driving unit 780. For example, a highly conductive adhesive may be used therefor such as mixed with a highly thermal conductive metal or the like. By virtue of this, the heat of the driving unit 780 is speedily transmitted to the heat sink 783 via the adhesive to effectively cool the driving unit 780.

Seventh Modified Embodiment

Figure 11:
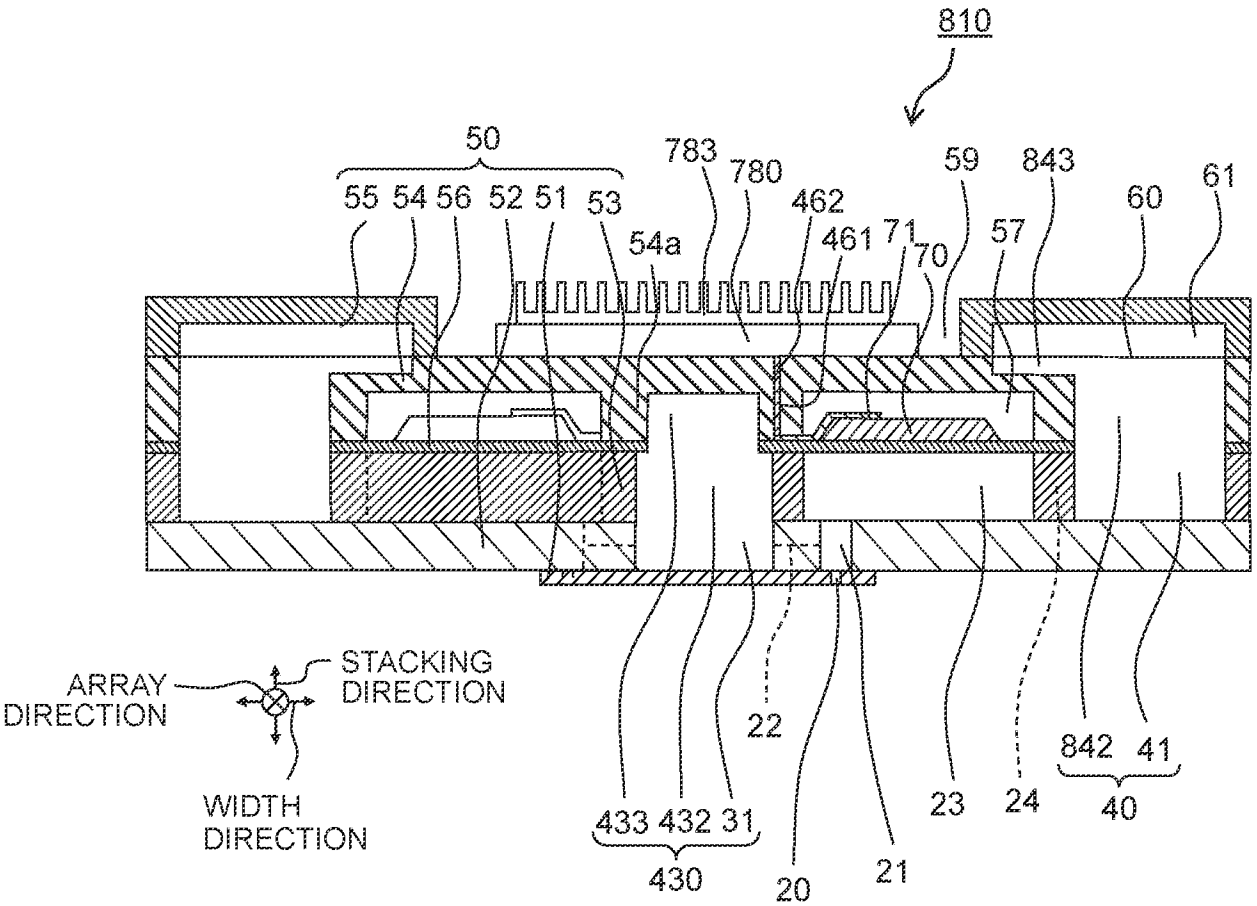
FIG. 11 is a schematic view of part of a head according to a seventh modified embodiment of the present disclosure.

In a head 810 according to a seventh modified embodiment, a second supply portion 842 of a supply common channel 840 may further have, as depicted in FIG. 11, a part expanding in the width direction (a wide portion 843).

The wide portion 843 expands along the width direction toward the third discharge portion 433 on the accommodation plate 54 above the accommodation portion 57 to overlap with the accommodation portion 57 along the stacking direction. Along the width direction, the part of the second supply portion 842 where the wide portion 843 is provided is sized larger than the other part of the second supply portion 842 and larger than the first supply portion 41. For example, the second supply portion 842 is sized 1000 μm along the width direction whereas the wide portion 843 is sized from 300 μm to 400 μm. Therefore, the part of the second supply portion 842 within the range where the wide portion 843 is formed (the maximum size of the second supply portion 842) is from 1300 μm to 1400 μm. By virtue of this, it is possible to maintain the flowage of the liquid in the wide portion 843 while exerting the heat dissipation effect.

The accommodation plate 54 is provided with the second supply portion 842 not only at the farther side from the third discharge portion 433 than the accommodation portion 57, but also above the accommodation portion 57 due to the wide portion 843. Therefore, the accommodation plate 54 increases in the surface area defining the second supply portion 842. Further, the second supply portion 842 projects toward the driving unit 780 due to the wide portion 843 along the width direction to approach the driving unit 780. Therefore, the heat from the driving unit 780 arranged on the upper surface of the accommodation plate 54 is speedily transmitted through the liquid in the second supply portion 842 via the accommodation plate 54, so as to effectively cool the driving unit 780.

Here, if the accommodation plate 54 is formed of a highly heat-conductive material such as silicon or the like, then the cooling efficiency for the driving unit 780 further increases. In this manner, because the second supply portion 842 is used not only as a channel for the liquid supplied to the pressure chambers 23 but also as a channel for the liquid cooling the driving unit 780, it is possible to cool the driving unit 780 without upsizing the nozzles 20.

In this manner, the opening portion of the second supply portion 842 in the upper surface of the accommodation plate 54 expands due to the wide portion 843. Hence, according to that, there are also expansions, along the width direction, of the damper film 60 covering the opening portion, the damper portions 61 at the far side from the second supply portion 842 to interpose the damper film 60, and the damper plate 55 enclosing the periphery of the damper portions 61.

Note that in the fifth, sixth, and seventh modified embodiments, in the same manner as in the fourth modified embodiment, the third discharge portions 433 and 633 are sized larger than the accommodation portions 57 along the stacking direction. Further, in the seventh modified embodiment, in the same manner as in the fifth modified embodiment, the center of the third discharge portion 433 may deviate from the center of the second discharge portion 432 along the width direction. Further, in the seventh modified embodiment, in the same manner as in the sixth modified embodiment, the driving unit 780 may be arranged on the upper surface of the accommodation plate 54.

Further, in the second embodiment and in the third to seventh modified embodiments, each of the corner-portions of the second discharge portion 432 and the third discharge portions 433, 533 and 633 may be curved as in the first modified embodiment or inclined as in the second modified embodiment.

Further, in the second embodiment and in the third to seventh modified embodiments, as in the third modified embodiment, the discharge common channels 430, 530 and 630 may be such sized along the width direction that the farther downstream, the smaller. Here, in the discharge common channels 430, 530 and 630, at least one of the first discharge portion 31, the second discharge portion 432, and the third discharge portions 433, 533 and 633 may be such sized along the width direction that the farther downstream, the smaller.

Third Embodiment

Figure 12:
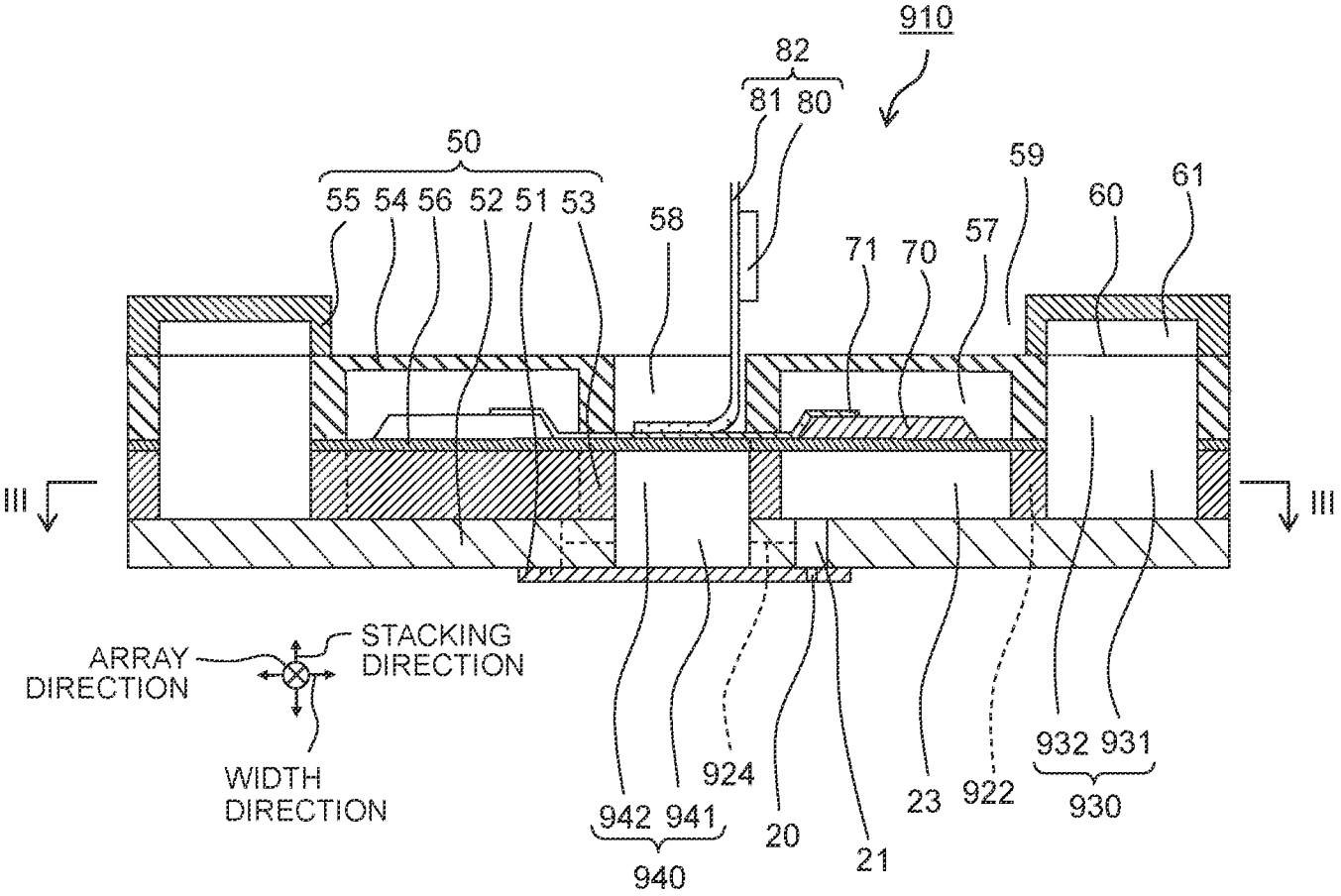
FIG. 12 is a schematic view of part of a head according to a third embodiment of the present disclosure.

In a head 910 according to a third embodiment of the present disclosure, as depicted in FIG. 12, between a discharge common channel 930 and a supply common channel 940, and between a discharge individual channel 922 and a supply individual channel 924, there is respective change in position as compared to the first embodiment. Because the other aspects are the same as the head 10 according to the first embodiment, explanations for the configuration, function and effect will be omitted.

In the communication plate 52, along the width direction, two supply individual channels 924 are arranged to interpose the first supply portion 941 of the first supply portion 941, and to be interposed between two descenders 21. The first supply portion 941 penetrates through the communication plate 52 along the stacking direction while the supply individual channels 924 are formed to sink in from the lower surface of the communication plate 52. The supply individual channels 924 render communication between the descenders 21 and the first supply portion 941.

In the pressure chamber plate 53, along the width direction, there is such an arrangement that the second supply portion 942 is interposed between two pressure chambers 23 which are further interposed between two discharge individual channels 922 which are further interposed between the first discharge portions 931 of two discharge common channels. The discharge individual channels 922 are arranged at the downstream side from the supply individual channels 924 along the width direction, to render communication between the first discharge portions 931 and the pressure chambers 23. The first discharge portions 931 penetrate through the pressure chamber plate 53 along the stacking direction while the second supply portions 942 are formed to sink in from the lower surface of the pressure chamber plate 53. The part left above the second supply portions 942 is sized equal to the vibration-plate portion 56 left above the pressure chambers 23 along the stacking direction. Note that the term "equal" is a concept including an allowable error such as manufacturing error or the like (for example, plus or minus 5%).

The second supply portions 942 are in communication with the first supply portions 941 and integral with the same to constitute the supply common channel 940 which is connected to the supply tube 18 (see FIG. 3). The second supply portions 942 are positioned as high as up to the (upper) surface of the pressure chambers 23 at the side of the piezoelectric elements 70 along the stacking direction. By virtue of this, the supply common channel 940 is expanded in the cross-sectional area orthogonal to the array direction. Hence, it is possible to lessen the resistance against the liquid flowing through the supply common channel 940, thereby facilitating improvement in the liquid discharge features.

In the accommodation plate 54, along the width direction, there is such an arrangement that the first hollow portion 58 is interposed between two accommodation portions 57 which are further interposed between two second discharge portions 932. The second discharge portions 932 penetrate through the accommodation plate 54 along the stacking direction, and are in communication with the first discharge portions 931 and integral with the same to constitute the discharge common channel 930 which is connected to the discharge tube 17 (see FIG. 3).

Figure 13:
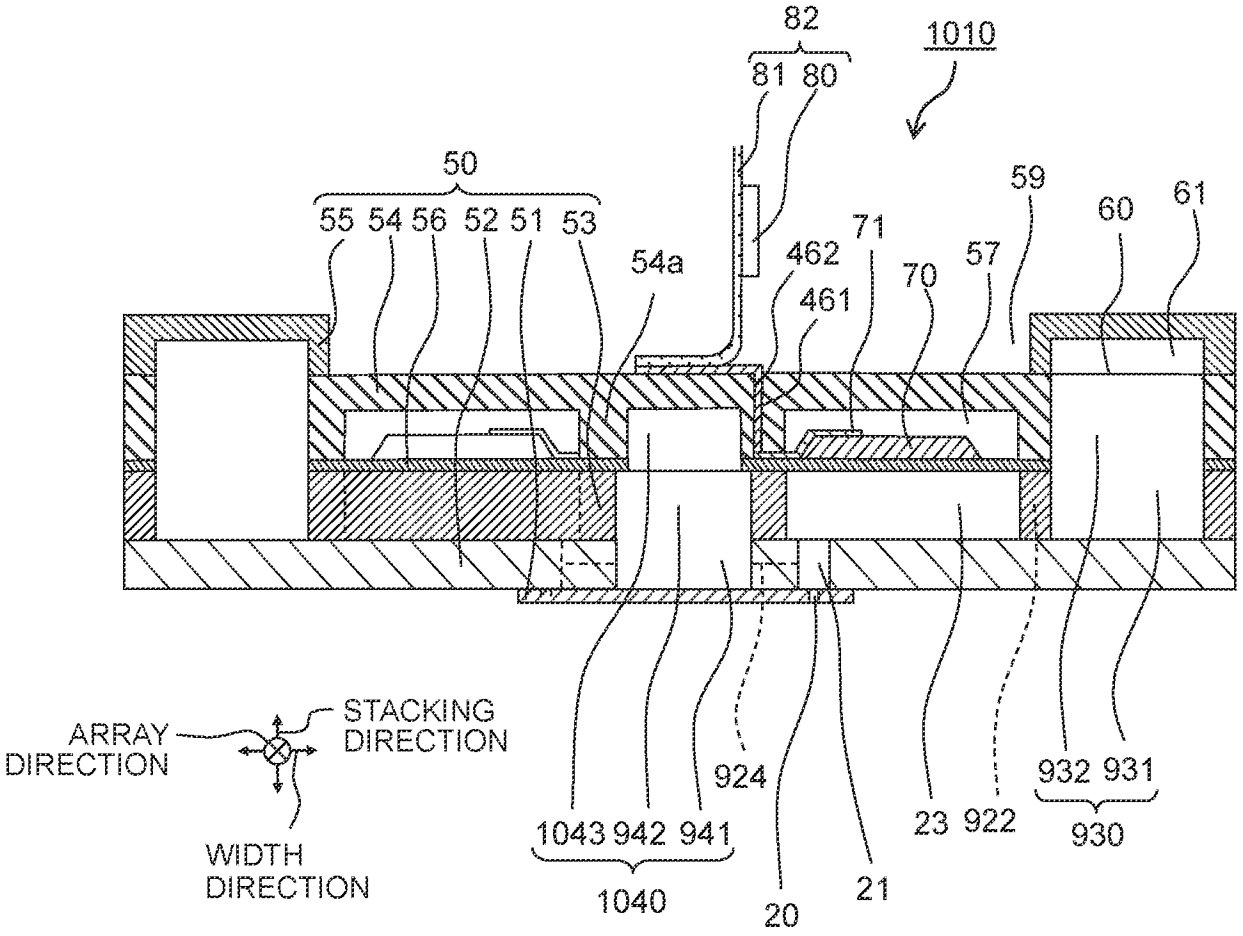
FIG. 13 is a schematic view of part of a head according to an eight modified embodiment of the present disclosure.

Note that in the third embodiment, in the same manner as in the second embodiment, as depicted in FIG. 13, a supply common channel 1040 may be formed in the accommodation plate 54, and there may further be a third supply portion 1043 in communication with the second supply portion 942. The third supply portion 1043 is formed to sink in from the lower surface of the accommodation plate 54 and sized the same as the accommodation portion 57 along the stacking direction and smaller than the second supply portion 942 along the width direction. The first supply portion 941, the second supply portion 942, and the third supply portion 1043 constitute, as one body, the supply common channel 1040. Because the supply common channel 1040 is further expanded due to the third supply portion 1043, it is possible to facilitate improvement in the liquid discharge features.

In an eighth modified embodiment based on the third embodiment, as in the fourth modified embodiment, the third supply portion 1043 may be sized larger along the stacking direction than the accommodation portion 57. Further, in the eighth modified embodiment based on the third embodiment, as in the fifth modified embodiment, the center of the third supply portion 1043 may deviate from the center of the second supply portion 942 along the width direction. Further, in the eighth modified embodiment based on the third embodiment, as in the sixth modified embodiment, the driving unit 780 may be arranged on the upper surface of the accommodation plate 54.

Further, in the third embodiment and in all modified embodiments based thereon, each of the corner-portions of the second supply portion 942 and the third supply portion 1043 may be curved as in the first modified embodiment or inclined as in the second modified embodiment.

Further, in the third embodiment and in all modified embodiments based thereon, as in the third modified embodiment, the supply common channel 1040 may be such sized along the width direction that the farther downstream, the smaller. Here, in the supply common channel 1040, at least one of the first supply portion 941, the second supply portion 942, and the third supply portion 1043 may be such sized along the width direction that the farther downstream, the smaller.

Note that in all the above embodiments and all the above modified embodiments, as far as not excluding the corresponding part from each other, every member may be combined with every other member. Further, the above explanation should be paraphrased as exemplifications and the present disclosure is provided for the purpose to inform those skilled in the art of the best mode for carrying out the invention. It is possible to practically change and modify the details of the structure and/or function of the present disclosure without departing from the true scope and spirit of the present disclosure.

The head of the present disclosure is usable as capable of facilitating improvement in liquid discharge features.

What is claimed is:

1. A liquid discharge head comprising:

a communication plate including a plurality of descenders in respective communication with a plurality of nozzles;

a pressure chamber plate stacked on the communication plate and including a plurality of pressure chambers in respective communication with the plurality of descenders;

a piezoelectric element arranged at a position overlapping with the pressure chambers in a stacking direction in which the communication plate and the pressure chamber plate are stacked;

a common channel extending in an array direction in which the plurality of pressure chambers is aligned and being in communication with the plurality of descenders commonly; and a plate stacked on the pressure chamber plate, wherein the common channel includes:

a first portion formed in the communication plate;

a second portion formed in the pressure chamber plate and in communication with the first portion; and a third portion formed in the plate and in communication with the second portion, and wherein the plurality of pressure chambers is connected to the common channel via the plurality of descenders.

2. The liquid discharge head according to claim 1, wherein the second portion is equal in length to the pressure chambers in the stacking direction.

3. The liquid discharge head according to claim 1, wherein the second portion is formed in the pressure chamber plate to sink in from a first surface of the pressure chamber plate facing the communication plate.

4. The liquid discharge head according to claim 1, wherein the second portion has a curved corner-portion between a surface of the second portion intersecting a width direction orthogonal to the array direction and the stacking direction, and another surface of the second portion intersecting the stacking direction.

5. The liquid discharge head according to claim 1, wherein the second portion has an inclined corner-portion between a surface of the second portion intersecting a width direction orthogonal to the array direction and the stacking direction, and another surface of the second portion intersecting the stacking direction.

6. The liquid discharge head according to claim 1, wherein the plate defines an accommodation portion in which the piezoelectric element is accommodated.

7. The liquid discharge head according to claim 6, wherein the third portion is equal in length to the accommodation portion in the stacking direction.

8. The liquid discharge head according to claim 6, wherein the third portion is larger in length than the accommodation portion in the stacking direction.

9. The liquid discharge head according to claim 6, further comprising a driving unit arranged on the accommodation portion at a far side from the third portion to drive the piezoelectric element, wherein the third portion is smaller in length than the driving unit in a width direction orthogonal to the array direction and the stacking direction.

10. The liquid discharge head according to claim 9, further comprising a pass-through electrode penetrating through the accommodation portion and being connected to the driving unit and the piezoelectric element.

11. The liquid discharge head according to claim 6, further comprising:

a film-like substrate of which one end is fixed on the accommodation portion at a far-side far from the third portion; and a driving unit mounted on the film-like substrate at the other end of the film-like substrate, wherein the center of the third portion is arranged nearer to the other end of the film-like substrate than the center of the second portion in a width direction orthogonal to the array direction and the stacking direction.

12. The liquid discharge head according to claim 11, further comprising a pass-through electrode penetrating through the accommodation portion and being connected to the driving unit and the piezoelectric element.

13. The liquid discharge head according to claim 1, wherein the common channel is configured for liquid to flow from one side to the other side in the array direction, and wherein a width of the common channel, in a width direction orthogonal to the array direction and the stacking direction, becomes smaller as the common channel extends in the array direction.

* * * * *